US009097074B2

(12) United States Patent
Shen et al.

(10) Patent No.: US 9,097,074 B2
(45) Date of Patent: Aug. 4, 2015

(54) POLYCRYSTALLINE DIAMOND COMPOSITES

(75) Inventors: Yuelin Shen, Houston, TX (US); Youhe Zhang, Tomball, TX (US); Sujian Huang, The Woodlands, TX (US); Madapusi K. Keshavan, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 304 days.

(21) Appl. No.: 11/858,817

(22) Filed: Sep. 20, 2007

(65) Prior Publication Data

US 2008/0073126 A1 Mar. 27, 2008

Related U.S. Application Data

(60) Provisional application No. 60/826,510, filed on Sep. 21, 2006.

(51) Int. Cl.
*E21B 10/567* (2006.01)

(52) U.S. Cl.
CPC ..... *E21B 10/567* (2013.01); *E21B 10/5676* (2013.01)

(58) Field of Classification Search
CPC . B22F 1/0014; B22F 2005/001; C22C 26/00; E21B 10/567; C04B 2235/427; B01J 2203/062; B01J 2203/0655; B23B 2226/315; B23B 27/148
USPC ..... 175/434
See application file for complete search history.

(56) References Cited

U.S. PATENT DOCUMENTS 2,941,241 A 6/1960 Strong
2,941,248 A 6/1960 Hall (Continued)

FOREIGN PATENT DOCUMENTS

EP 0 196 777 A1 10/1986
EP 0 272 913 A2 6/1988

(Continued)

OTHER PUBLICATIONS

Mole, Nicholas, "Patents Act 1977: Search Report under Section 17(5)," 4 pages.

(Continued)

*Primary Examiner* — Shane Bomar
*Assistant Examiner* — Kipp Wallace
(74) *Attorney, Agent, or Firm* — Snell & Wilmer L.L.P.

(57) ABSTRACT

Polycrystalline diamond composites comprise a polycrystalline diamond body having a plurality of ultra-hard discrete regions dispersed within a polycrystalline diamond second region. The plurality of discrete regions has an density different from of the polycrystalline diamond second region. A metallic substrate can be joined to the body. The discrete regions can be relatively more thermal stable than, have a higher diamond density than, and/or may comprise a binder material that is different from the polycrystalline diamond second region. Polycrystalline diamond composites can be formed by combining already sintered granules with diamond grains to form a mixture, and subjecting the mixture to high pressure/high temperature conditions, wherein the granules form the plurality of discrete regions, or can be made by forming a plurality of unsintered granules, combining them with diamond grains to form a mixture, and then subjecting the mixture to first and second high pressure/high temperature conditions.

23 Claims, 7 Drawing Sheets

(56) References Cited

U.S. PATENT DOCUMENTS

| | | | | |
|---|---|---|---|---|
| 2,947,611 | A | 8/1960 | Bundy | |
| 3,136,615 | A | 6/1964 | Bovenkerk et al. | |
| 3,141,746 | A | 7/1964 | Lai | |
| 3,233,988 | A | 2/1966 | Wentorf, Jr. et al. | |
| 3,609,818 | A | 10/1971 | Wentorf, Jr. | |
| 3,767,371 | A | 10/1973 | Wentorf, Jr. et al. | |
| 4,104,344 | A | 8/1978 | Pope et al. | |
| 4,108,614 | A | 8/1978 | Mitchell | |
| 4,151,686 | A | 5/1979 | Lee et al. | |
| 4,224,380 | A | 9/1980 | Bovenkerk et al. | |
| 4,255,165 | A | 3/1981 | Dennis et al. | |
| 4,268,276 | A | 5/1981 | Bovenkerk | |
| 4,288,248 | A | 9/1981 | Bovenkerk et al. | |
| 4,289,503 | A | 9/1981 | Corrigan | |
| 4,311,490 | A | 1/1982 | Bovenkerk et al. | |
| 4,373,593 | A | 2/1983 | Phaal et al. | |
| 4,403,015 | A | 9/1983 | Nakai | |
| 4,486,286 | A | 12/1984 | Lewin et al. | |
| 4,504,519 | A | 3/1985 | Zelez | |
| 4,505,746 | A | 3/1985 | Nakai et al. | |
| 4,522,633 | A | 6/1985 | Dyer | |
| 4,525,178 | A | 6/1985 | Hall | |
| 4,556,403 | A | 12/1985 | Almond et al. | |
| 4,604,106 | A | 8/1986 | Hall | |
| 4,605,343 | A | 8/1986 | Hibbs, Jr. et al. | |
| 4,606,738 | A | 8/1986 | Hayden | |
| 4,621,031 | A | 11/1986 | Scruggs | |
| 4,636,253 | A | 1/1987 | Nakai et al. | |
| 4,645,977 | A | 2/1987 | Kurokawa et al. | |
| 4,664,705 | A | 5/1987 | Horton et al. | |
| 4,673,414 | A | 6/1987 | Lavens et al. | |
| 4,707,384 | A | 11/1987 | Schachner et al. | |
| 4,766,040 | A | 8/1988 | Hillert et al. | |
| 4,850,523 | A | 7/1989 | Slutz | |
| 4,854,405 | A | 8/1989 | Stroud | |
| 4,861,350 | A | 8/1989 | Phaal et al. | |
| 4,871,377 | A | 10/1989 | Frushour | |
| 4,899,922 | A | 2/1990 | Slutz et al. | |
| 4,919,220 | A | 4/1990 | Fuller et al. | |
| 4,940,180 | A | 7/1990 | Martell | |
| 4,944,772 | A | 7/1990 | Cho | |
| 4,954,139 | A | 9/1990 | Cerutti | |
| 4,959,929 | A | 10/1990 | Burnand et al. | |
| 4,976,324 | A | 12/1990 | Tibbitts | |
| 5,011,514 | A * | 4/1991 | Cho et al. | 51/295 |
| 5,030,276 | A | 7/1991 | Sung et al. | |
| 5,039,311 | A * | 8/1991 | Bloecher | 51/295 |
| 5,096,465 | A * | 3/1992 | Chen et al. | 51/295 |
| 5,127,923 | A | 7/1992 | Bunting et al. | |
| 5,135,061 | A | 8/1992 | Newton, Jr. | |
| 5,176,720 | A | 1/1993 | Martell et al. | |
| 5,186,268 | A | 2/1993 | Clegg | |
| 5,337,844 | A | 8/1994 | Tibbitts | |
| 5,355,969 | A | 10/1994 | Hardy et al. | |
| 5,370,195 | A | 12/1994 | Keshavan et al. | |
| 5,379,853 | A | 1/1995 | Lockwood et al. | |
| 5,494,477 | A | 2/1996 | Flood et al. | |
| 5,496,638 | A | 3/1996 | Waldenstrom et al. | |
| 5,510,193 | A | 4/1996 | Cerutti et al. | |
| 5,523,121 | A | 6/1996 | Anthony et al. | |
| 5,524,719 | A | 6/1996 | Dennis | |
| 5,560,716 | A | 10/1996 | Tank et al. | |
| 5,603,070 | A | 2/1997 | Cerutti et al. | |
| 5,645,617 | A | 7/1997 | Frushour | |
| 5,662,720 | A | 9/1997 | O-Tighearnaigh | |
| 5,667,028 | A | 9/1997 | Truax et al. | |
| 5,722,497 | A | 3/1998 | Gum et al. | |
| 5,722,499 | A | 3/1998 | Nguyen et al. | |
| 5,833,021 | A | 11/1998 | Mensa-Wilmot et al. | |
| 5,853,873 | A | 12/1998 | Kukino et al. | |
| 5,875,862 | A | 3/1999 | Jurewicz et al. | |
| 5,887,580 | A | 3/1999 | Eyre | |
| 5,889,219 | A | 3/1999 | Moriguchi et al. | |
| 6,041,875 | A | 3/2000 | Rai et al. | |
| 6,054,693 | A | 4/2000 | Barmatz et al. | |
| 6,063,333 | A | 5/2000 | Dennis | |
| 6,098,730 | A | 8/2000 | Scott et al. | |
| 6,132,675 | A | 10/2000 | Corrigan et al. | |
| 6,193,001 | B1 | 2/2001 | Eyre et al. | |
| 6,216,805 | B1 | 4/2001 | Lays et al. | |
| 6,248,447 | B1 | 6/2001 | Griffin et al. | |
| 6,258,139 | B1 | 7/2001 | Jensen | |
| 6,315,065 | B1 * | 11/2001 | Yong et al. | 175/428 |
| 6,332,503 | B1 | 12/2001 | Pessier et al. | |
| 6,344,149 | B1 | 2/2002 | Oles | |
| 6,367,568 | B2 | 4/2002 | Steinke et al. | |
| 6,443,248 | B2 | 9/2002 | Yong et al. | |
| 6,550,556 | B2 | 4/2003 | Middlemiss et al. | |
| 6,592,985 | B2 | 7/2003 | Griffin et al. | |
| 6,601,662 | B2 | 8/2003 | Matthias et al. | |
| 6,852,414 | B1 | 2/2005 | Frushour | |
| 6,892,836 | B1 | 5/2005 | Eyre et al. | |
| 6,904,984 | B1 | 6/2005 | Estes et al. | |
| 6,935,444 | B2 | 8/2005 | Lund et al. | |
| 6,991,049 | B2 | 1/2006 | Eyre et al. | |
| 7,048,081 | B2 | 5/2006 | Smith et al. | |
| 7,070,635 | B2 | 7/2006 | Frushour | |
| 7,350,601 | B2 | 4/2008 | Belnap et al. | |
| 7,506,698 | B2 | 3/2009 | Eyre et al. | |
| 2002/0071729 | A1 | 6/2002 | Middlemiss et al. | |
| 2003/0024351 | A1 * | 2/2003 | Pender et al. | 75/243 |
| 2003/0235691 | A1 | 12/2003 | Griffin et al. | |
| 2004/0238227 | A1 * | 12/2004 | Smith et al. | 175/431 |
| 2005/0051366 | A1 * | 3/2005 | Frushour | 175/434 |
| 2005/0133277 | A1 * | 6/2005 | Dixon | 175/426 |
| 2006/0060390 | A1 | 3/2006 | Eyre | |
| 2006/0060392 | A1 | 3/2006 | Eyre et al. | |
| 2006/0162969 | A1 | 7/2006 | Belnap et al. | |
| 2006/0266558 | A1 | 11/2006 | Middlemiss et al. | |
| 2007/0187155 | A1 | 8/2007 | Middlemiss | |
| 2008/0178535 | A1 | 7/2008 | Wan | |
| 2009/0095538 | A1 * | 4/2009 | Middlemiss | 175/432 |
| 2009/0152015 | A1 | 6/2009 | Sani et al. | |

FOREIGN PATENT DOCUMENTS

| | | | |
|---|---|---|---|
| EP | 0 329 954 | A2 | 8/1989 |
| EP | 0 352 811 | A1 | 1/1990 |
| EP | 0 500 253 | A1 | 8/1992 |
| EP | 0 617 207 | A2 | 9/1994 |
| EP | 0 706 981 | A2 | 4/1996 |
| EP | 0 787 820 | A2 | 8/1997 |
| EP | 0 860 515 | A1 | 8/1998 |
| EP | 1 190 791 | A2 | 3/2002 |
| EP | 1 515 837 | | 3/2005 |
| GB | 2 261 894 | A | 6/1993 |
| GB | 2 270 492 | A | 3/1994 |
| GB | 2282833 | | 4/1995 |
| GB | 2 323 398 | A | 9/1998 |
| GB | 2345503 | | 7/2000 |
| GB | 2362655 | | 11/2001 |
| GB | 2 418 215 | A | 3/2006 |
| RU | 2 034 937 | C1 | 5/1995 |
| WO | 93/23204 | A1 | 11/1993 |
| WO | 00/28106 | A1 | 5/2000 |
| WO | 2004000543 | | 12/2003 |
| WO | 2004/106003 | A1 | 12/2004 |
| WO | 2004/106004 | | 12/2004 |
| WO | WO 2004111284 | | 12/2004 |

OTHER PUBLICATIONS

Radtke et al.; Faster Drilling, Longer Life: Thermally Stable Diamond Drill Bit Cutters; GasTIPS; Summer 2004; pp. 5-9.

* cited by examiner

FIG. 5
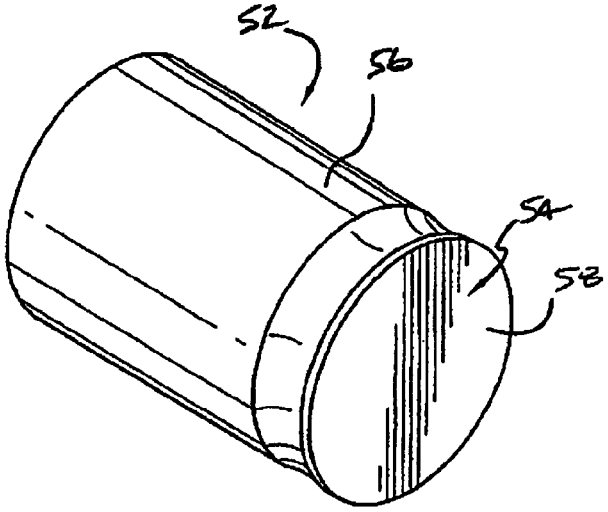
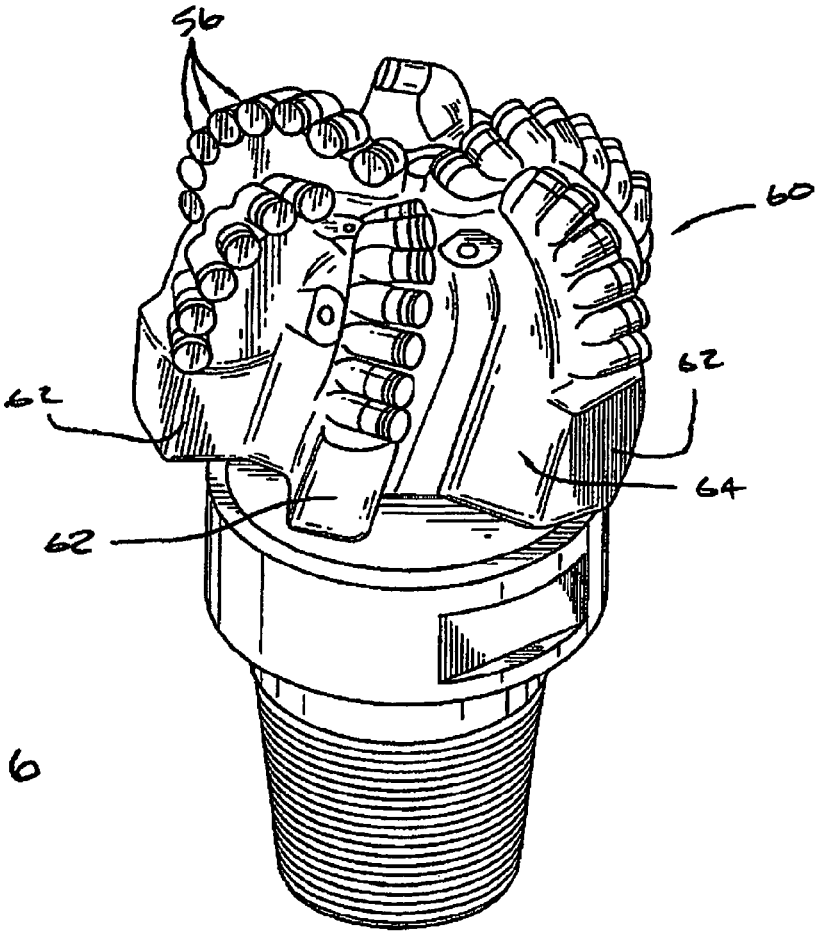
FIG. 6

POLYCRYSTALLINE DIAMOND COMPOSITES

CROSS-REFERENCE TO RELATED APPLICATIONS

This patent application claims the benefit of U.S. Provisional Patent Application No. 60/826,510, filed Sep. 21, 2006, which application is herein incorporated by reference in its entirety.

FIELD OF THE INVENTION

The invention relates generally to polycrystalline diamond composites and, more particularly, to polycrystalline diamond composites that have been specially engineered to have a material microstructure comprising a plurality of discrete regions having thermal stability, abrasion resistance, wear resistance, polycrystalline material density, and/or catalyst material type and/or content that is different from that of surrounding matrix or continuous polycrystalline diamond region to provide desired improved properties of wear resistance, abrasion resistance, and/or thermal stability to the overall composite.

BACKGROUND OF THE INVENTION

Polycrystalline diamond (PCD) has been widely used as wear and/or cutting elements in industrial applications, such as for drilling subterranean formations and metal machining for many years. Typically, such PCD cutting elements are provided in the form of a compact that comprises a body formed from PCD (or other super hard material), and that is attached to substrate material, which is typically a sintered metal-carbide to form a cutting structure. Such compact body comprises a polycrystalline mass of diamonds (typically synthetic) that are bonded together to form an integral, tough, high-strength mass or lattice. In such conventional PCD, the body is formed of a uniform or homogeneous distribution of diamond bonded crystals. The resulting PCD structure produces enhanced properties of wear resistance and hardness, making PCD materials extremely useful in aggressive wear and cutting applications where high levels of wear resistance and hardness are desired.

Conventional PCD compacts can be formed by placing a cemented carbide substrate into a container of a press. A desired mixture of diamond grains, or diamond grains and catalyst binder, is placed adjacent the substrate and treated under high pressure, high temperature (HPHT) conditions. In doing so, the metal binder material present in the substrate (often cobalt) infiltrates from the substrate and passes through the diamond grains to promote intercrystalline bonding between the diamond grains. As a result, the diamond grains become bonded to each other to form the PCD body, and the PCD body is in turn bonded to the substrate. The substrate often comprises a metal-carbide composite material, such as tungsten carbide. The so formed PCD body is often referred to as the "diamond table" or "abrasive layer" of the compact or cutting element structure.

Conventional PCD includes in the range of from about 85-95% by volume diamond and a balance binder or catalyst material, which binder or catalyst material is present in the PCD microstructure within interstitial regions existing between the bonded together diamond grains. Binder or catalyst materials that are typically used in forming PCD include metal solvent materials selected from Group VIII of the Periodic table, with cobalt (Co) being the most common. Further, such conventional PCD comprises a material microstructure made of a substantially uniform phase of bonded together diamond crystals, with the binder or catalyst material disposed within interstitial regions that exist between the bonded diamond crystals.

A problem known to exist with conventional PCD construction, i.e., those comprising a uniform or homogeneous microstructure of bonded together diamond grains is that when used as a cutting element on a drill bit, the rate of penetration (ROP) or speed in which the drill bit progresses through such hard formations may often be reduced, or slowed. This is believed due to the fact that the homogeneous structure of the PCD cutting element is unable to provide cutting surfaces or edges that will optimally engage and remove formation material. Further, conventional PCD having such a homogeneous diamond bonded microstructure, having homogeneous wear characteristics, may allow an initially sharp cutting edge to become rounded with use. Such rounding or dulling of the cutting edge also reduces the ability and effectiveness of the cutting element to remove the formation material A further problem known to exist with such conventional PCD materials is that they are vulnerable to thermal degradation, when exposed to elevated temperature cutting and/or wear applications, caused by the differential that exists between the thermal expansion characteristics of the interstitial catalyst material and the thermal expansion characteristics of the intercrystalline bonded diamond. Such differential thermal expansion is known to occur at temperatures of about 400° C., can cause ruptures to occur in the diamond-to-diamond bonding, and eventually result in the formation of cracks and chips in the PCD structure, rendering the PCD structure unsuited for further use.

Another form of thermal degradation known to exist with conventional PCD materials is one that is also related to the presence of the metal catalyst in the interstitial regions and the adherence of the solvent metal catalyst to the diamond crystals. Specifically, the solvent metal catalyst is known to cause an undesired catalyzed phase transformation in diamond (converting it to carbon monoxide, carbon dioxide, or graphite) with increasing temperature, thereby limiting practical use of the PCD material to about 750° C.

Attempts at addressing such unwanted forms of thermal degradation in conventional PCD materials are known in the art. Generally, these attempts have focused on the formation of a PCD body having an improved degree of thermal stability when compared to the conventional PCD materials discussed above. One such known technique of producing a PCD body having improved thermal stability involves, after forming the PCD body, removing all or a portion of the solvent catalyst material therefrom.

For example, U.S. Pat. No. 6,544,308 discloses a PCD element having improved wear resistance comprising a diamond matrix body that is integrally bonded to a metallic substrate. While the diamond matrix body is formed using a catalyzing material during high temperature/high pressure processing, the diamond matrix body is subsequently treated to render a region extending from a working surface to a depth of at least about 0.1 mm substantially free of the catalyzing material.

Other references disclose the practice of removing substantially all of the catalyst material from the PCD body, thereby forming so-called thermally stable polycrystalline diamond or TSP. While this approach produces an entire PCD body that is substantially free of the solvent catalyst material, is it fairly time consuming. Additionally, a problem known to exist with this approach is that the lack of solvent metal catalyst within the PCD body precludes the subsequent attachment of a metallic substrate to the PCD body by solvent catalyst infiltration.

Additionally, such TSP materials have a coefficient of thermal expansion that is sufficiently different from that of conventional substrate materials (such as WC-Co and the like) that are typically infiltrated or otherwise attached to the PCD body. The attachment of such substrates to the PCD body is highly desired to provide a PCD compact that can be readily adapted for use in many desirable applications. However, the difference in thermal expansion between the TSP body and the substrate, and the poor wetability of the TSP body diamond surface due to the substantial absence of solvent metal catalyst, makes it very difficult to bond TSP to conventionally used substrates. Accordingly, such TSP bodies must be attached or mounted directly to a device for use, i.e., without the presence of an adjoining substrate.

Since such TSP bodies are devoid of a metallic substrate they cannot (e.g., when configured as a cutting element for use on a bit for subterranean drilling) be attached to such drill bit by conventional brazing process. The use of such TSP bodies in this particular application necessitates that the TSP body itself be mounted to the drill bit by mechanical or interference fit during manufacturing of the drill bit, which is labor intensive, time consuming, and does not provide a most secure method of attachment.

While these above-noted known approaches provide insight into diamond bonded constructions capable of providing some improved degree of wear resistance, abrasion resistance, and/or thermal stability when compared to conventional PCD constructions, it is believed that further improvements in one or more such properties for PCD materials useful for desired cutting and wear applications can be obtained according to different approaches that are both capable of minimizing the amount of time and effort necessary to achieve the same, and that permit formation of a PCD composite having improved such one or more improved properties comprising a desired substrate bonded thereto to facilitate attachment of the construction with a desired application device.

It is, therefore, desired that polycrystalline diamond constructions be developed having a polycrystalline diamond body engineered to have an improved degree of thermal stability and/or wear/abrasion resistance when compared to conventional PCD materials, and that include a substrate material bonded to the polycrystalline body to facilitate attachment of the resulting construction to an application device by conventional method such as welding or brazing and the like. It is further desired that such polycrystalline diamond constructions also be capable of providing a desired degree of impact resistance and strength that is the same as or that exceeds that of conventional PCD.

SUMMARY OF THE INVENTION

Polycrystalline diamond composites comprise a polycrystalline diamond body having a plurality of discrete regions. The plurality of discrete regions is dispersed within a polycrystalline diamond second region. The plurality of discrete regions comprises an ultra-hard material and has an ultra-hard material density that is different from that of a diamond density of the polycrystalline diamond second region. The polycrystalline diamond composite can further include a metallic substrate joined to the body.

In an example embodiment, the discrete regions are relatively more thermal stable than the polycrystalline diamond region. For example, they can be stable at operating temperatures that are greater than about 750° C., in some embodiments thermally stable at operating temperatures up to about 950° C., and in still other embodiments thermally stable at operating temperatures up to about 1,200° C. The discrete regions may comprise a material selected from the group consisting of thermally stable diamond, cubic boron nitride, polycrystalline cubic boron nitride, carbonado diamond, polycrystalline diamond, and mixtures thereof.

In an example embodiment, the discrete regions are formed from polycrystalline diamond, and can have a diamond density that is greater than about 98 percent by volume. In an example embodiment, the diamond density of the discrete regions is greater than that of the polycrystalline diamond region. When the discrete regions are formed from polycrystalline diamond, they can comprise a binder material that is different from that in the polycrystalline diamond region. For example, the binder material in the discrete regions can have a melting temperature that is less than that of the binder material in the polycrystalline diamond region. Further, the binder material in the discrete regions may have a coefficient of thermal expansion that more closely matches that of the polycrystalline diamond of the discrete regions as compared to the binder material in the polycrystalline diamond region.

The plurality of discrete regions can be substantially uniformly dispersed within the polycrystalline diamond region. Alternatively, the plurality of discrete regions can be localized within the body adjacent at least a portion the body outside surface.

Polycrystalline diamond composites can be made by forming a plurality of sintered granules comprising an ultra-hard material. These sintered granules are then combined with diamond grains to form a mixture. The mixture is then subjected to a high pressure/high temperature process in the presence of a catalyst material to sinter the diamond grains thereby forming a material microstructure comprising a plurality of discrete regions formed by the plurality of granules dispersed within a polycrystalline diamond region formed by the sintered diamond grains. As noted above, the so-formed plurality of discrete regions is different from the polycrystalline diamond region in at least one of the following respects, thermal stability, abrasion resistance, wear resistance, ultra-hard material density.

Polycrystalline diamond composite can also be made by forming a plurality of unsintered granules comprising an ultra-hard material and a first binder material, and combining the plurality of granules with diamond grains to form a mixture. The mixture is then subjected to a first high pressure/high temperature condition in the presence of a second binder material to melt the first binder and sinter the plurality of granules. The mixture is then subjected to a second high pressure/high temperature condition in the presence of the second binder material to melt the second binder to sinter the diamond grains, thereby forming a material microstructure comprising a plurality of discrete regions formed by the plurality of sintered granules that is dispersed within a polycrystalline diamond region formed by the sintered diamond grains. As noted above, the so-formed plurality of discrete regions is different from the polycrystalline diamond region in at least one of the following respects, thermal stability, abrasion resistance, wear resistance, ultra-hard material density.

Such polycrystalline diamond constructions are engineered to have an improved degree of thermal stability and/or wear/abrasion resistance when compared to conventional PCD materials, and are further constructed to include a substrate material bonded to the polycrystalline body to facilitate attachment of the resulting construction to an application device by conventional method such as welding or brazing and the like. Such polycrystalline diamond construction also provide a desired degree of impact resistance and strength that is the same as or that exceeds that of conventional PCD.

BRIEF DESCRIPTION OF DRAWINGS

These and other features and advantages of the present invention will be appreciated as the same becomes better understood by reference to the following detailed description when considered in connection with the accompanying drawings wherein:

FIG. 5 is a schematic perspective side view of a shear cutter comprising the PCD composite construction of this invention;

FIG. 6 is a perspective side view of a drag bit comprising a number of the shear cutters of FIG. 5;

DETAILED DESCRIPTION

In one aspect, embodiments of the invention relate to PCD composite constructions having a plurality of discrete regions dispersed in a polycrystalline diamond region, where the discrete regions have properties of thermal stability, polycrystalline density, binder or catalyst material type and/or content, wear resistance, and/or abrasion resistance that differ from that of a polycrystalline diamond material surrounding the plurality of discrete regions. Moreover, embodiments of this invention relate to cutting and/or wear elements including such PCD composite constructions and methods of forming the same.

Figure 1:
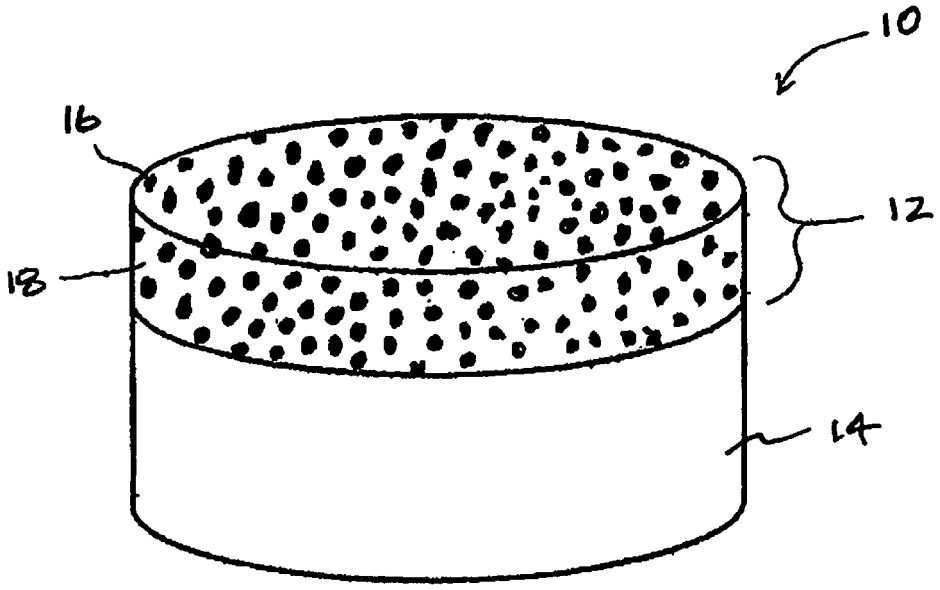
FIG. 1 is schematic view of an example embodiment PCD composite construction prepared according to principles of the invention.

FIG. 1 illustrates a PCD composite construction, prepared according to principles of this invention, that is provided in the form of a compact 10, e.g., one that can be configured for use as a cutting and/or a wear element for an end use application. The PCD composite compact 10 includes a polycrystalline diamond body 12 that is disposed on a substrate 14. The polycrystalline diamond body 12 comprises a material microstructure that includes a plurality of discrete regions 16 that is dispersed in a substantially continuous polycrystalline diamond region 18.

The polycrystalline diamond region 18 may include intercrystalline bonded diamond and binder/catalyst material disposed within interstitial regions between the bonded diamond crystals. The polycrystalline diamond region 18 can be produced by subjecting a desired volume of individual diamond crystals or grains to sufficient HPHT conditions such that intercrystalline bonding occurs between the adjacent diamond crystals. This process is facilitated by the presence of a binder or catalyst material either with the volume of diamond grain, or as an infiltrate from an adjacent substrate material during the HPHT process. Suitable binder/catalyst materials useful for forming the polycrystalline diamond region include cobalt and/or other Group VIII elements.

The polycrystalline diamond region can be formed by combining natural or synthetic diamond powder having an average diameter grain size that ranges from submicrometer to about 100 micrometers, and preferably in the range of from about 1 to 50 micrometers. The diamond powder may contain grains having a desired mono- or multi-modal size distribution. As noted above, the binder or catalyst material can be provided along with the diamond grains, e.g., in the form of a separate powder or as a coating on the grain, to facilitate intercrystalline bonding of the diamond grains during the HPHT process. Alternatively or in addition, the binder or catalyst material can be provided from the substrate material during the HPHT process by infiltration into the diamond grain volume. In a particular embodiment, where the binder or catalyst material is added to the diamond grain volume as a powder, a cobalt powder is preferably used and has an average grain size in the range of from submicrometer to about 50 micrometers. The binder or catalyst material may be used in a range up to about 30 percent by weight based on the total weight of the polycrystalline diamond region formed.

The polycrystalline diamond region of the PCD composite body disclosed herein can be formed in a conventional manner, such as by a HPHT sintering of "green" particles to create intercrystalline bonding between the particles. Examples of HPHT processes useful for sintering the polycrystalline diamond region can be found, for example, in U.S. Pat. Nos. 4,694,918; 5,370,195; and 4,525,178, which are herein incorporated by reference. Briefly, to form the polycrystalline diamond region, an unsintered mass of the diamond grains is placed within a metal enclosure of a reaction cell of a HPHT apparatus. A metal catalyst, such as cobalt, may be included with the unsintered mass of diamond grain. The reaction cell is then placed under temperature and pressure processing conditions sufficient to cause the intercrystalline bonding between the diamond particles. A suitable HPHT apparatus for this process is described in U.S. Pat. Nos. 2,947,611; 2,941,241; 2,941,248; 3,609,818; 3,767,371; 4,289,503; 4,673,414; and 4,954,139, which are incorporated herein by reference.

As noted above, a feature of PCD composite constructions of this invention is the presence of the discrete regions 18 dispersed within the polycrystalline diamond region 20, wherein the plurality if discrete region have desired properties that are different from that of the surrounding polycrystalline diamond region 20. The discrete regions 18 can be formed as a consolidated and/or sintered part separately from the formation of the polycrystalline diamond region, or can be provided as a green-state unconsolidated and/or unsintered part that is subsequently consolidated and/or sintered in situ during sintering of the polycrystalline diamond region.

If the discrete regions are sintered during the same process as the polycrystalline diamond region, a two-stage sintering process, e.g., where the temperature and/or pressure is adjusted during sintering, can be used to permit consolidation and sintering of the discrete regions prior to the consolidation and sintering of the surrounding polycrystalline diamond region.

It is to be understood that the amount or volume of the plurality of discrete regions in the PCD composite construction relative to the polycrystalline diamond region can and will vary to impart desired properties such as thermal stability, wear resistance, and/or abrasion resistance, while also seeking to maintain the strength and impact resistance of the PCD composite construction, as called for by the particular end use application. In an example embodiment, the plurality of discrete regions can comprise in the range of from about 1 to 90 volume percent of the cutting structure, and preferably in the range of from about 15 to 80 volume percent. The volume of the plurality of regions will depend on such factors as the types of materials and/or grain size of materials used to form both the discrete regions and the polycrystalline diamond region, and/or the size and configuration of the structure comprising the PCD composite of this invention, e.g., the size and the configuration of a cutting element when used with a drill bit.

As used herein, the term "discrete regions" refers a plurality of discrete regions dispersed in the polycrystalline diamond region disclosed herein having at least one of a thermal stability, wear resistance, abrasion resistance, binder or catalyst material type and/or content, and/or polycrystalline material type and/or density that is different than that of the polycrystalline diamond region surrounding the discrete regions. Such properties can be provided through the selective choice of materials used to form the discrete regions, the proportions of materials used to form the discrete regions, and/or the treatment of materials used to form the discrete regions.

The discrete regions may comprise materials selected from the group including cubic boron nitride (cBN), polycrystalline cubic boron nitride (PcBN), thermally stable polycrystalline diamond (TSP), carbonado diamond, polycrystalline diamond (PCD), and mixtures thereof. In the case of PCD, the discrete regions may be formed from PCD having a different diamond density than the surrounding polycrystalline diamond region, PCD formed using diamond grains sized differently from that used to form the surrounding polycrystalline diamond region, PCD having a different binder material and/or catalyst material than that of the surrounding polycrystalline diamond region, and/or PCD having a different binder material and/or catalyst material content than that of the surrounding polycrystalline diamond region, and mixtures thereof.

In an example embodiment, where difference in thermal stability is desired, e.g., where it is desired that the discrete regions be relatively more thermally stable than the surrounding polycrystalline diamond region, PCD can be used to form the discrete regions, wherein such PCD may have a diamond density that is greater than that of the surrounding polycrystalline diamond region, or have a binder material or catalyst material content that is less than that of the surrounding polycrystalline diamond region. Alternatively, or in addition to increased diamond density or reduced catalyst material content, such PCD can be formed using a binder material or catalyst having a coefficient of thermal expansion that more closely matches that of the polycrystalline diamond in the discrete regions, e.g., that is less thermally expansive than the binder material or catalyst material used to form the surrounding polycrystalline diamond region.

Conventional PCD is stable at temperatures of up to 700-750° C., after which observed increases in temperature may result in deterioration and structural failure of polycrystalline diamond. This deterioration in polycrystalline diamond is due to the significant difference in the coefficient of thermal expansion of the binder material, cobalt, as compared to diamond. Upon heating of polycrystalline diamond, the cobalt and the diamond lattice will expand at different rates, which may cause cracks to form in the diamond lattice structure and result in deterioration of the polycrystalline diamond.

Accordingly, in an example embodiment where it is desired that the plurality of discrete regions have a degree of thermal stability that is relatively greater than that of the surrounding polycrystalline diamond region, the discrete regions preferably are thermally stable at operating temperatures greater than about 750° C. For certain end use applications, it may be desired that the discrete regions be thermally stable at operating temperatures up to about 950° C. In still other end use applications, it may be desired that the discrete regions be thermally stable at operating temperatures up to about 1,200° C.

The plurality of discrete regions present in PCD composite constructions of this invention may exist in a number of different sizes and configurations. For example, the discrete regions can be provided in the form or polygons, spheres, plates, discs, rods, fibers, or the like, which may optionally be used for providing a desired performance characteristic. For example, the plurality of discrete regions may be configured and/or sized to provide particular thermal stability, crack propagation, strength, and/or impact resistance characteristics within the composite. In an example embodiment, the discrete regions may have a size of from about 20 to 5,000 micrometers, and preferably in the range of from about 100 to 250 micrometers. It is understood that the size and/or configuration of the discrete regions can and will vary based on such factors as the materials used to form the PCD composite construction, the configuration of the construction, and/or the particular end use application.

As briefly noted above, the discrete regions in PCD composites of this invention can be formed from carbonado diamond, a naturally formed type of polycrystalline diamond, and other types of polycrystalline diamond that are formed naturally, e.g., that are formed within earthen formations. Such naturally formed forms of polycrystalline diamond may have beneficial properties, such as diamond density and/or the presence of materials other than binder and/or catalyst material, that can operate to provide a desired property difference when compared to the surrounding polycrystalline diamond region of the PCD composites.

In an example embodiment, PCD composites of this invention comprise a plurality of discrete regions formed from cBN, and such cBN discrete regions are dispersed within a polycrystalline diamond region. cBN refers to an internal crystal structure of boron atoms and nitrogen atoms in which the equivalent lattice points are at the corner of each cell. Boron nitride particles typically have a diameter of approximately one micron and appear as a white powder. Boron nitride, when initially formed, has a generally graphite-like, hexagonal plate structure. When compressed at high pressures (such as $10^6$ psi), cBN particles will be formed with a hardness very similar to diamond, and a stability in air at temperatures of up to 1,400° C. Alternatively, the discrete regions can be formed form PcBN.

According to one embodiment of the invention, the discrete regions when formed from cBN or PcBN may include a cBN or PcBN content of at least 50 percent by volume; at least 70 percent by volume in another embodiment; and at least 85 percent by volume in yet another embodiment. The residual content such cBN discrete regions may include at least one of Al, Si, and mixtures thereof, carbides, nitrides, carbonitrides and borides of Group IVa, Va, and VIa transition metals of the periodic table. Mixtures and solid solutions of Al, Si, carbides, nitrides, carbonitrides and borides of Group IVa, Va, and VIa transition metals of the periodic table may also be included.

In another embodiment, PCD composites of this invention comprise a plurality of discrete regions formed from TSP, and such TSP discrete regions are dispersed within a polycrystalline diamond region. TSP useful in this regard may be formed by removing the binder or catalyst material, such as cobalt, from polycrystalline diamond and thereby reducing the unwanted thermal expansion difference associated with having the catalyst material present The binder or catalyst material can be removed from polycrystalline diamond by a number of different techniques known in the art. In an example embodiment, the binder or catalyst material can removed by exposing the polycrystalline diamond to an acid to leach the catalyst material from the diamond lattice structure. Examples of leaching processes can be found, for example, in U.S. Pat. Nos. 4,288,248 and 4,104,344, which are incorporated herein by reference. Briefly, a heated strong acid, e.g., nitric acid, hydrofluoric acid, hydrochloric acid, or perchloric acid, or combinations of several strong acids may be used to treat the polycrystalline diamond, removing a desired portion of the catalyst material from the polycrystalline diamond material.

The amount of catalyst material removed from the polycrystalline diamond material, forming the TSP discrete regions, can vary depending on the particular desired properties of the discrete regions and the overall PCD composite construction. For example, in certain embodiments it may be desired that the polycrystalline diamond material be completely leached, e.g., where a high degree of thermal stability is desired and impact resistance is of lesser important, or partially leached, e.g., where a lesser degree of thermal stability is desired and impact resistance of greater importance. The TSP discrete regions can be formed by either leaching the PCD material provided in the form of particles, or by first leaching a PCD material body and then forming the resulting TSP body into particles useful as the discrete regions.

With respect to using TSP for forming the PCD composite discrete regions, such TSP can be used without further consolidation before being introduced into the mixture used to form the surrounding polycrystalline diamond region. Alternatively, such TSP can be subjected to desired treatments for the purpose of reducing and/or filling the interstitial voids or volumes resulting from the removal of the catalyst material. For example, the TSP can be subjected to a consolidation process after leaching for the purpose of reducing the interstitial voids before being combined with the mixture used to form the surrounding polycrystalline diamond region. Alternatively, the TSP can be treated by filling in the interstitial voids with a replacement or secondary material, such as by processes known in the art and described in U.S. Pat. No. 5,127,923, which is herein incorporated by reference. Example materials useful for filling the voids in TSP can include materials that do not act as a catalyst material to facilitate diamond bonding, or that cause the diamond-bonded crystals in the TSP to undergo any undesired changes during operating conditions.

As noted above, the discrete regions can be formed from PCD having a binder or catalyst material that is different from that used to form the surrounding polycrystalline diamond region. In an example embodiment, the binder or catalyst material used to form the PCD discrete regions can be one having a coefficient of thermal expansion that is closer to diamond than that of conventional solvent metal catalyst material such as cobalt or the like. Examples of such binder or catalyst materials include silicon or silicon carbide. During the manufacturing process, a large portion, 80 to 100 volume percent, of the silicon reacts with carbon in the diamond lattice to form silicon carbide which also has a thermal expansion similar to diamond. Upon heating, any remaining silicon, silicon carbide, and the diamond lattice will expand at more similar rates as compared to rates of expansion for cobalt and diamond, resulting in a more thermally stable material. PCD formed by using silicon and/or silicon carbide may have thermal stability and low wear rates even as temperatures reach 1,200° C. U.S. Patent Publication No. 2005/0230156, which is herein incorporated by reference, describes polycrystalline diamond composites made with a silicon getter material that may also be used in the PCD composite constructions disclosed herein.

PCD composite constructions of this invention can be formed by using discrete regions as provided in a post-sintered state, such as cBN, TSP, carbonado diamond, or PCD, and then adding such post-sintered discrete regions as desired to the mixture of PCD precursor materials, e.g., diamond grains, used to form the polycrystalline diamond region. If desired, a substrate can be added to the mixture to produce a compact. Further, depending on the particular material that is used to form the discrete regions, it may be desired to treat the exterior surface of the discrete regions, e.g., by coating with a barrier material or the like, to ensure that the solvent catalyst material used to form the surrounding polycrystalline diamond region does not infiltrate into the discrete regions. Examples of suitable materials useful as barrier materials can include ceramic materials, refractory metals, and/or materials that would not have a catalytic impact on the polycrystalline material in the discrete region at sintering and/or end-use operating temperatures.

The combined discrete regions, mixture of PCD precursor material, and optional substrate are assembled together and loaded into a container that is placed into an HPHT device, and the device is operated to impose a desired HPHT condition onto the contents of the container that is calculated to sinter the precursor mixture and optionally join the resulting PCD composite body to a substrate, thereby resulting in the formation of a PCD composite compact.

Alternatively, PCD constructions of this invention can be formed by using discrete regions as provide in an unsintered or "green" state. In an example embodiment, the discrete regions can be provided in the form of granules, e.g., such as those formed as described in U.S. Patent Publication No. 2002/0194955, which is herein incorporated by reference. In such example embodiment, the diamond granules can be prepared by blending synthetic diamond powder with a polymer binder and a binder or catalyst material, and pelletizing or otherwise shaping the diamond and polymer mix into small diamond pellets or granules. If desired, the resulting green-state diamond granules can be coated with a material, such as one that can act as a barrier to prevent the infiltration of the binder or catalyst material from the surrounding precursor materials used to form the polycrystalline diamond region during HPHT processing. Such green-state diamond granules can be coated with a metal and/or cermet material.

In another embodiment described by U.S. Patent Publication No. 2002/0194955, the green-state granules can be prepared by taking a diamond precursor material (formed from diamond powder, an organic binder, and binder metal), granulating the diamond precursor material. The resulting granules can be treated or coated with those materials noted above, e.g., with a desired barrier material, metal, or cermet. Suitable diamond precursor materials include diamond tape that is formed by combining synthetic diamond powder with a binder material, e.g., cobalt, and an organic binder, and forming the combined mixture into a desired sheet or web. Diamond powder and binder metal powder can be the same as that described above for forming green-state diamond granules as noted above.

The green-state diamond precursor can be granulated into desired size particles, e.g., a diamond precursor in the form of diamond tape is chopped into small particles, wherein each particle comprises a combination of diamond powder, metal binder powder, and organic binder. If desired, the so-formed granulated diamond particles can optionally be coated.

The discrete regions may also be formed from a process known as "tape casting" in conjunction with high pressure/high temperature (HPHT) diamond synthesis technology, such as that described in U.S. Pat. Nos. 5,766,394 and 5,379,853, which are herein incorporated by reference in their entirety. In the tape casting process, a fine diamond powder is mixed with a temporary organic binder. This mixture is mixed and milled to the most advantageous viscosity and then cast or calendared into a sheet (tape) of a desired thickness. The tape is dried to remove water or organic solvents. The dried tape is flexible and strong enough in this state to be handled and cut into shapes as desired to be dispersed into a PCD composite disclosed herein. The tape pieces are initially heated in a vacuum furnace to a temperature high enough to drive off any organic binder material. The temperature is then raised to a level where the crystalline powders fuse to each other. Consolidation/sintering of the pieces may occur either prior to or post mixing with the precursor materials used to form the surrounding polycrystalline diamond region. The diamond tape and/or formed pieces may optionally include a coating to reduce/prevent formed pieces from sticking and sintering together. It should also be understood that cubic boron nitride particles, or other ultra hard material particles, may be used in lieu of diamond particles in the fabrication of tape castings.

In another embodiment, the discrete regions may also be formed in a process similar to the formation of polycrystalline diamond bodies with a textured surface described in U.S. Pat. No. 4,629,373, which is herein incorporated by reference. Diamond powder and binder may be placed in a screen having a mesh size corresponding to the desired sizes of the discrete regions and pressed. Due to the high heat and pressure required to form polycrystalline diamond, and because polycrystalline diamond has formed in the screen apertures, the polycrystalline diamond and screen are bonded together. The polycrystalline diamond may then be acid treated, which results in removal of cobalt, as well as dissolution of the screen, leaving TSP pieces.

In an example embodiment where the discrete regions are initially provided in the form of green-state diamond granules, that are to be combined and sintered together with the precursor mixture used to form the surrounding polycrystalline diamond region, it is desired that such green-state granules be formed from diamond grains and other binder or catalyst materials that when sintered will provide one or more properties of thermal stability, wear resistance, and/or abrasion resistance that are different from that of the sintered surrounding polycrystalline diamond material. Such desired different properties can be achieved by using different types of ultra-hard materials, different types of binder or catalyst materials, different sizes of materials, and or different proportions of materials.

In an example embodiment, it is desired that the binder material or catalyst material in the precursor mixture used to form the polycrystalline diamond region not be permitted to infiltrate into the green-state diamond granules during the sintering process. In such example embodiment, such unwanted infiltration can be avoided by the selective use of different binder materials or catalyst materials for forming the green-state granules than that used to form the precursor mixture. In an example embodiment, it may be desired that the binder or catalyst material used to form the green-state granules have a melting temperature that is less than that of the binder or catalyst material used to form the precursor mixture, thereby permitting the selective sintering of the green-state granules first at a lower temperature during a HPHT process. Once the green-state granules have been sintered, the temperature of the HPHT process can be increased to the melting temperature of the binder or catalyst material used to with the precursor material to facilitate the sintering of such mixture and the resulting formation of the polycrystalline diamond region.

Accordingly, in such example embodiment the binder or catalyst material used to sinter the green-state material is selected from the group of materials that will facilitate bonding together of the precursor ultra-hard constituent in the green-state granule, e.g., diamond grains, at a temperature that is below that of the catalyst material used in the precursor mixture to form the sintered polycrystalline diamond region. In an example embodiment, silicon can be used as the relatively low-melting point binder or catalyst material. In such example embodiment, cobalt is used as the binder or catalyst material for forming the precursor mixture.

During HPHT processing of the combined green-state granules and precursor mixture, the HPHT device is controlled so that it achieves a first HPHT condition, to facilitate sintering of the green-state granules, and is then controlled to achieve a second HPHT condition, to facilitate sintering of the surrounding precursor mixture, thereby forming both the plurality of discrete regions and surrounding polycrystalline diamond region in a single HPHT cycle. In such example embodiment, the pressure is held constant for both the first and second HPHT conditions, while the temperature of the second HPHT condition is greater than that of the first HPHT condition.

It is to be understood that the exact pressures and temperatures used during such HPHT processing to achieve the sequential sintering noted above can and will vary depending on such factors as the particular choice of materials that are used for forming the green-state granules and precursor mixture, as well as the type of device that is used to perform the HPHT process. During the second HPHT condition, because the granules have already been consolidated and sintered to form the plurality of discrete regions, the binder or catalyst material that is now melted will infiltrate into the diamond grains in the precursor mixture. It is believed that during this second HPHT condition, the binder or catalyst material in the precursor mixture will not infiltrate the already sintered discrete regions.

Accordingly, in the example noted above, the discrete regions comprise polycrystalline diamond with silicon, that may exist interstitially between the bonded together diamond crystals, and/or that may react with carbon in the diamond to form silicon carbide that may also reside in interstitially within the bonded together diamond crystals or that may operate to bond the diamond crystals together as a reaction product.

The discrete regions of the PCD composite that are formed in situ with the polycrystalline diamond region can be specially engineered to provide the desired properties noted above. For example, the green-state granules can be formulated having a diamond density that is different from that of the precursor mixture, having a different binder or catalyst content than that of the precursor mixture, made from different materials and/or materials having different proportions and/or grain sizes than that of the precursor mixture to achieve the desired difference in properties. For example, relatively discrete regions formed having a relatively higher diamond density when compared to the surrounding polycrystalline diamond region can provide improved properties of wear and abrasion resistance as well as improved thermal stability to the resulting PCD composite construction.

In another example embodiment, PCD composites of this invention are formed by taking already-sintered PCD pieces, having the desired properties noted above. In an example embodiment, the PCD pieces can be prepared by sintering under significantly higher pressure and/or higher temperature conditions than that subsequently used to consolidate and sinter the precursor mixture to form the surrounding polycrystalline diamond region. In such example, the already-sintered PCD pieces are combined with the precursor mixture and any desired substrate for form an assembly, and the assembly is loaded into a container and placed into the HPHT device, wherein an HPHT process is carried out to form the PCD composite. In this example, using separate HPHT processes for sintering the discrete regions and the surrounding polycrystalline diamond region enables one to form discrete regions of PCD having a relatively high diamond density, which again provides improved properties of wear and abrasion resistance as well as thermal stability due to the relatively reduced binder or catalyst content.

Alternatively, a PCD composite constructions of this invention can be formed by using cBN, TSP, and/or natural diamond as the material for forming discrete regions, and such materials are combined with the precursor mixture, e.g., diamond grains and a binder or catalyst material, for forming the polycrystalline diamond region. In an example embodiment, sintered TSP granules may be incorporated with the precursor mixture to form a preconsolidated mixture of sintered discrete regions dispersed in a mixture of diamond grains and a binder or catalyst material. Sintered TSP granules may be selected from the TSP materials noted above, and the resulting PCD composite comprises discrete regions of TSP dispersed within a polycrystalline diamond region. In another particular embodiment, natural diamond and/or cBN granules, either sintered or green, may be incorporated with the precursor mixture to form a plurality of discrete natural diamond and/or cBN regions dispersed in a preconsolidated mixture of diamond grains and a metal binder.

It is to be understood that the sintering processing conditions for forming PCD composites of this invention may require alteration depending on whether the discrete regions are green or sintered when incorporated with the diamond grains and binder. If the unconsolidated mixture contains green discrete volumes, the process temperatures/pressures may, for example, be performed in a two-step process as noted above to allow for sintering of the discrete regions prior to sintering of the surrounding polycrystalline diamond region.

In one embodiment, PCD composites of this invention may have a material microstructure comprising a plurality of discrete regions that are substantially uniformly dispersed within the polycrystalline diamond region. Alternatively, the plurality of discrete regions may be randomly or selectively dispersed in the polycrystalline diamond region so as to occupy one or more particular regions of the composite.

Figure 2:
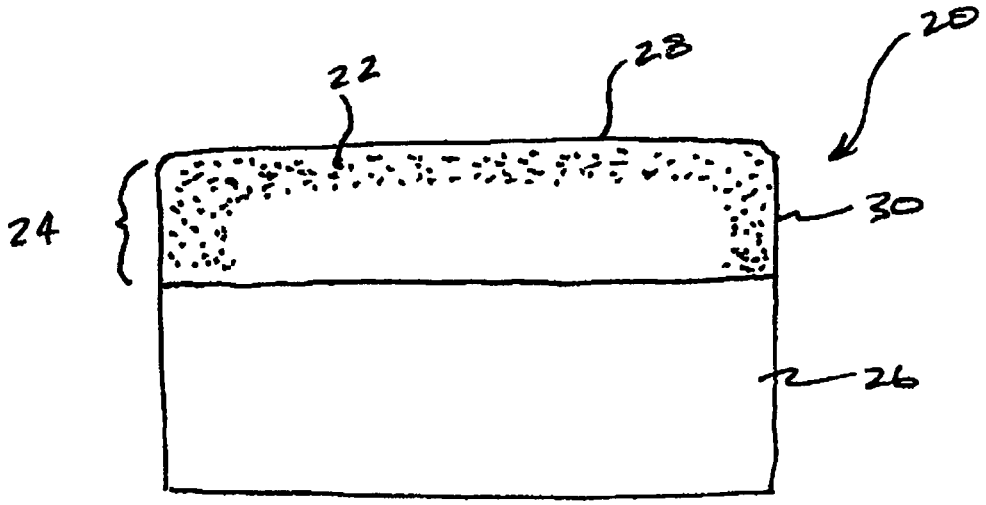
FIG. 2 is a cross-sectional view of one example embodiment PCD composite construction of this invention.

FIG. 2 illustrates an example embodiment PCD composite 20 of this invention where the plurality of discrete regions 22 has been selectively positioned within the PCD composite body 24. For example, PCD composites of this invention can be configured such that the plurality of discrete regions are positioned adjacent a wear and/or cutting surface of the particular construction, and are not positioned uniformly through out the entire body. In the event that the PCD composite construction is provided in the form of a compact cutting element, i.e., comprising a PCD composite body 24 that is attached to a substrate 26, the PCD composite may be engineered such that the discrete regions are positioned along all or part of the top surface of the PCD body and/or the side surface of the PCD body, depending on the particular end use application. In such example embodiment, the discrete regions can extend a desired depth from the top and/or side surface that is calculated to provide the desired PCD composite performance properties when placed into a particular end use application.

In the example embodiment illustrated in FIG. 2, the PCD composite body is configured such that the plurality of discrete regions 22 are positioned along both a top surface 28 and a side surface 30 of the body 24. As noted above, the depth that the plurality of discrete regions extend from the top and side surface can and will vary depending on the particular end use application. While the example illustrated in FIG. 2 illustrates the discrete regions as being positioned along both the top and side surface, it is to be understood that the placement position of the discrete regions can be along one or the other surfaces, and may only occupy a partial portion of any such region.

Figure 3:
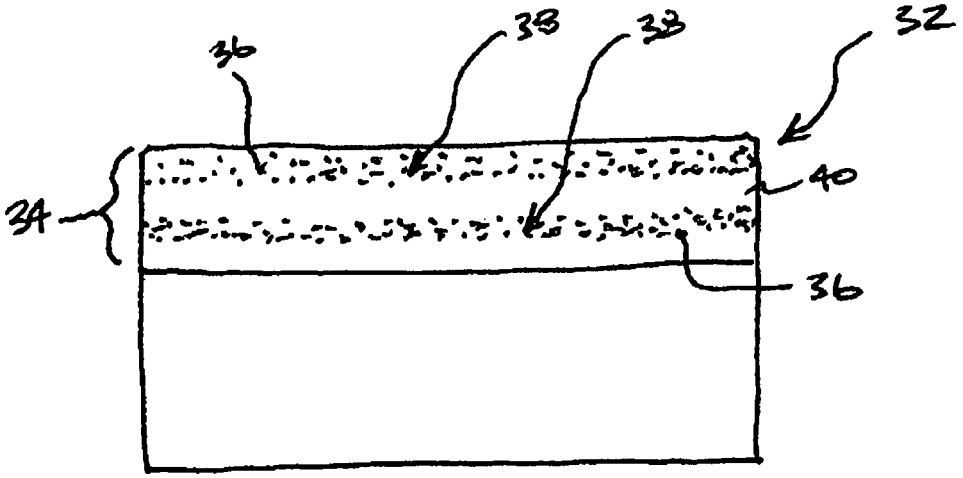
FIG. 3 is a cross-sectional view of another example embodiment PCD composite construction of this invention.

Alternatively, the plurality of discrete regions may be positioned within the PCD composite to extend along one or more entire or partial region of the PCD composite. FIG. 3 illustrates and example embodiment PCD composite 32 of this invention comprising a PCD composite body 34 wherein the plurality of discrete regions 36 are provided in the form of one or more layers 38 within the polycrystalline diamond region 40, wherein the layers can be positioned differently as called for by the particular end use application. Accordingly, it is to be understood that PCD composites of this invention may include discrete regions that are positioned within the polycrystalline diamond region as desired to provide desired performance properties for a particular end us application.

Figure 4:
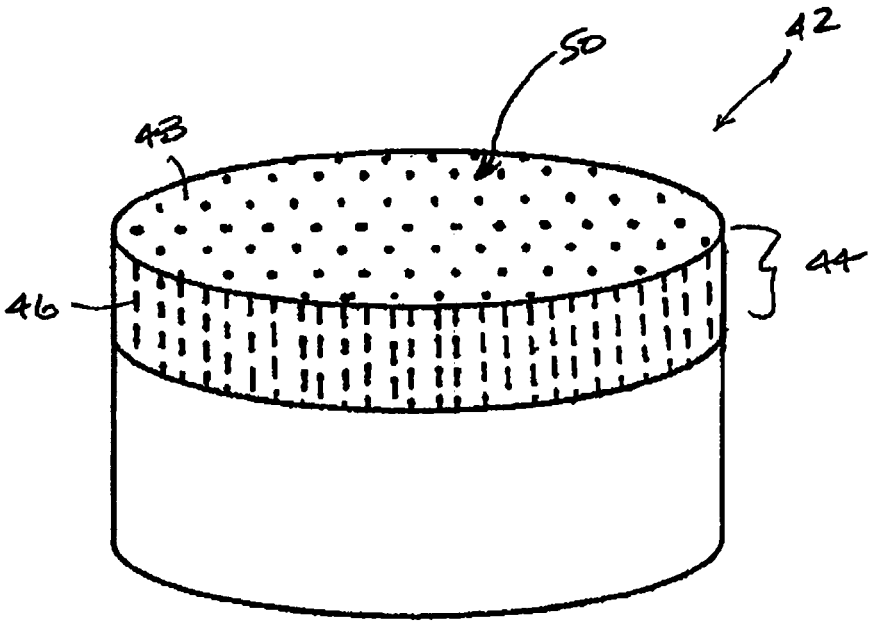
FIG. 4 is schematic view of another example embodiment PCD composite construction of this invention.

In addition to the placement position of the discrete regions within the PCD composite, the discrete regions themselves may be configured to provide desired properties to the PCD composite. FIG. 4 illustrates an example PCD composite 42 of this invention comprising a PCD composite body 44 that is engineered having the plurality of discrete regions 46 configured in the shape of rods. In this particular embodiment, the plurality of discrete rods 46 are each dispersed and positioned within the surrounding polycrystalline diamond region 48 having a common substantially parallel orientation. In this particular embodiment, the plurality of discrete rods is oriented with their axis perpendicular to a top surface 50 of the body. It is to be understood that this is but one example of how the discrete regions themselves can be configured and/or oriented within the PCD composite body, and that discrete regions that are shaped and oriented differently than that illustrated in FIG. 4 are within the scope of this invention.

In one embodiment, a PCD composites of this invention can be provided in the form of a compact, comprising the PCD body joined or attached to a carbide substrate, and the compact can be configured in the form of a cutting and/or wear element. The cutting element may be formed with application of HPHT processing that will cause diamond crystals to sinter to each other and to the dispersed discrete regions and form a PCD composite. In another embodiment, a carbide substrate may be included in the reaction cell with the diamond mixture. Similarly, application of HPHT to the composite material will cause the diamond crystals and carbide particles to sinter such that they are no longer in the form of discrete particles that can be separated from each other, bonding the polycrystalline diamond and the substrate to each other during the HPHT process to form a cutting element.

The polycrystalline diamond cutting structures disclosed herein may be used in variety of wear operations, such as tools for mining, cutting, machining, and construction applications, which the combined properties of thermal stability, wear, and abrasion resistance are desired. PCD cutting structures of this invention may be used to form cutting elements in machine tools and drill bits, such as fixed cutter bits, roller cone rock bits, percussion or hammer bits, and diamond bits.

FIG. 5 illustrates a PCD composite of this invention as embodied in the form of a shear cutter 52 used, for example, with a drag bit for drilling subterranean formations. The PCD shear cutter comprises a PCD composite body 54 that is sintered or otherwise attached to a cutter substrate 96 as described above. The PCD body includes a working or cutting surface 58 that can include the top and/or side surface of the body. It is to be understood that PCD composites of this invention can be used to form shear cutters having geometries other than that specifically described above and illustrated in FIG. 5.

FIG. 6 illustrates a drag bit 60 comprising a plurality of the PCD composite shear cutters 56 described above and illustrated in FIG. 5. The shear cutters are each attached to blades 62 that extend from a head 64 of the drag bit for cutting against the subterranean formation being drilled. Because the PCD composite shear cutters of this invention include a metallic substrate, they are attached to the blades by conventional method, such as by brazing or welding.

Figure 7:
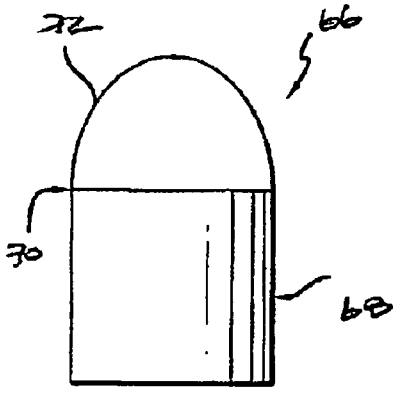
FIG. 7 is a perspective side view of an insert, for use in a roller cone or a hammer drill bit, comprising the PCD composite construction of this invention.

FIG. 7 illustrates a PCD composite of this invention provided in the form of an insert 66 used in a wear or cutting application in a roller cone drill bit or percussion or hammer drill bit. For example, such PCD composite inserts 66 are constructed having a substrate portion 68, formed from one or more of the substrate materials disclosed above, that is attached to a PCD composite body 70 having a the plurality of discrete regions. In this particular embodiment, the insert comprises a domed working surface 72. The insert can be pressed or machined into the desired shape or configuration. It is to be understood that PCD composites can be used with inserts having geometries other than that specifically described above and illustrated in FIG. 7.

Figure 8:
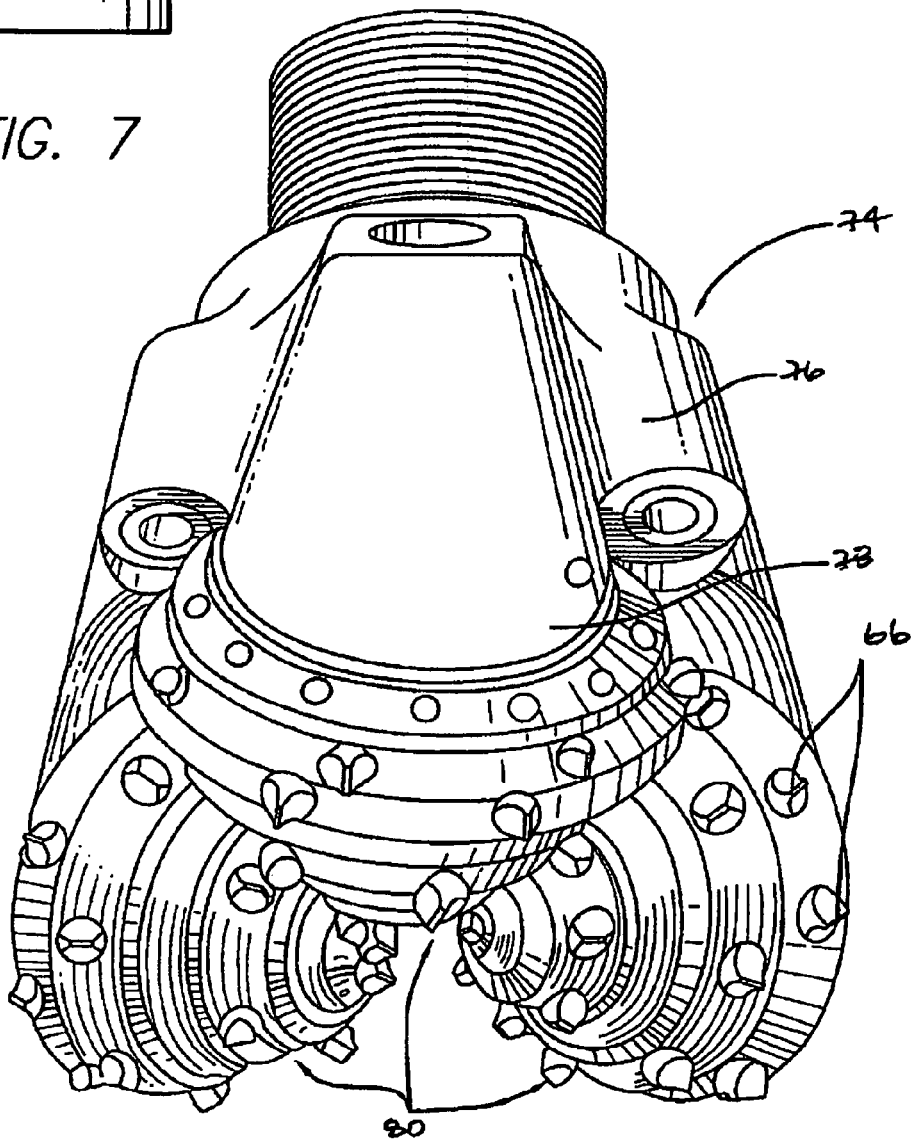
FIG. 8 is a perspective side view of a roller cone drill bit comprising a number of the inserts of FIG. 7.

FIG. 8 illustrates a rotary or roller cone drill bit in the form of a rock bit 74 comprising a number of the wear or cutting PCD composite inserts 66 disclosed above and illustrated in FIG. 7. The rock bit 74 comprises a body 76 having three legs 78 extending therefrom, and a roller cutter cone 80 mounted on a lower end of each leg. The inserts 66 are the same as those described above comprising the PCD composite constructions of this invention, and are provided in the surfaces of each cutter cone 80 for bearing on a rock formation being drilled.

Figure 9:
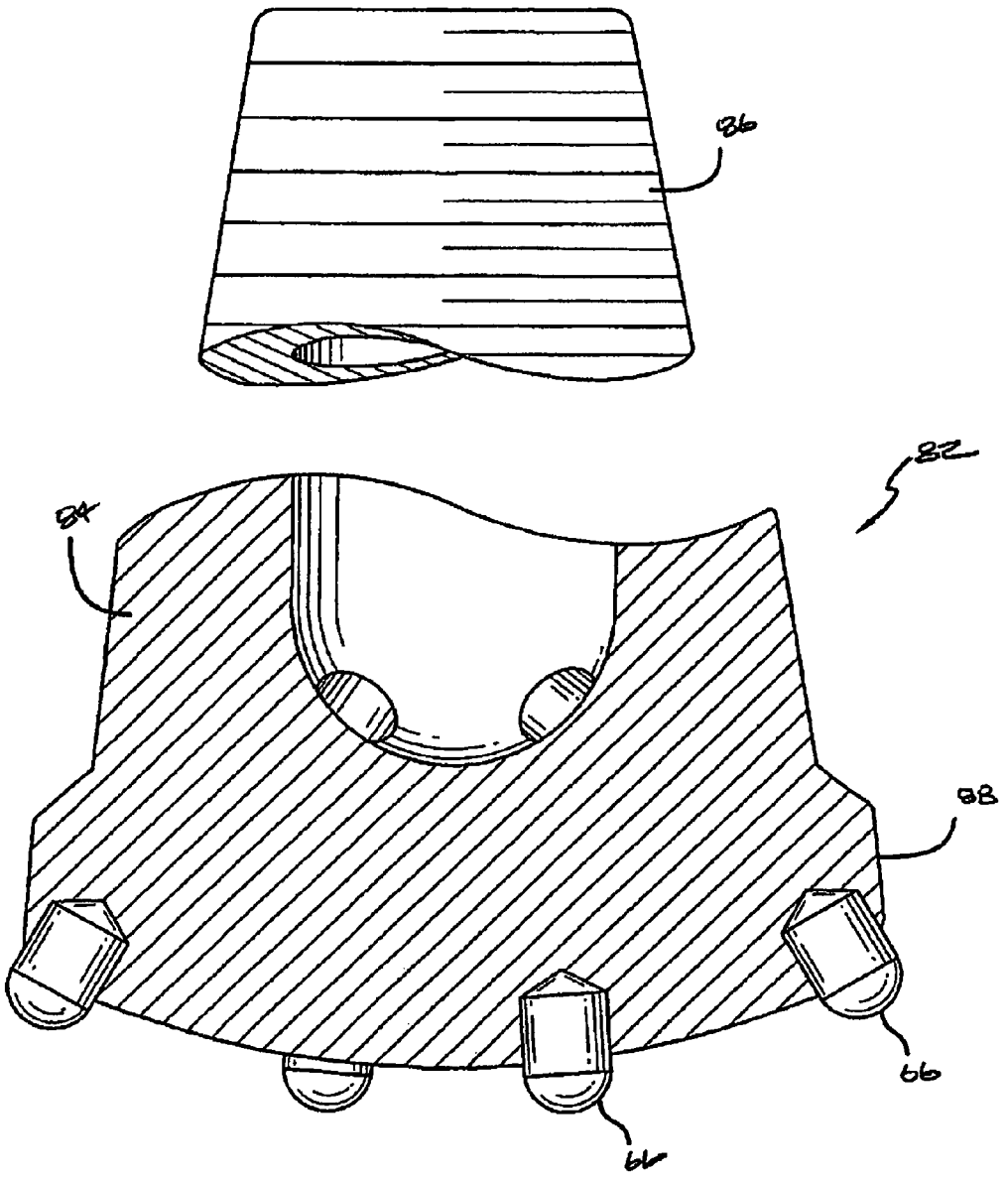
FIG. 9 is a perspective side view of a percussion or hammer bit comprising a number of inserts of FIG. 7.

FIG. 9 illustrates the PCD insert described above and illustrated in FIG. 7 as used with a percussion or hammer bit 82. The hammer bit generally comprises a hollow steel body 84 having a threaded pin 86 on an end of the body for assembling the bit onto a drill string (not shown) for drilling oil wells and the like. A plurality of the inserts 66 is provided in the surface of a head 88 of the body 84 for bearing on the subterranean formation being drilled.

A feature of PCD composites of the present invention is that the plurality of discrete regions can be formed having properties of thermal stability, abrasion resistance, and/or wear resistance that is different than the surrounding of polycrystalline diamond region. In some embodiments, it may be desired that the plurality of discrete regions have one or more of the above-noted properties that are improved over the same property of the polycrystalline diamond region. For example, for certain end use applications, it is desired that the plurality of discrete regions have a thermal stability that is greater than that of the remaining polycrystalline diamond region. The increases in thermally stability can be achieved by the selecting the types, amounts and/or sizes of material used to from the discrete regions. In an example embodiment, it is desired that the discrete regions be formed from PCD, and the diamond density of such discrete regions be greater than that of the polycrystalline diamond region.

Configured in this manner, PCD composites of this invention enable one to achieve those performance properties by controlling the amount and/or placement of the discrete regions within the PCD composite body, to thereby enable one to achieve an optimum combination of performance properties such thermal stability, wear resistance, abrasion resistance, impact resistance and strength as a whole to best suit a particular end use application. PCD composites of this invention when configured as cutting elements provide suitability for use in high speed drilling operations where such above-noted properties are typically desired. Additionally, due to the difference in material properties between the polycrystalline diamond region and the discrete regions, wear of a cutting element formed therefrom may produce an irregularly sharp cutting edges, which may lead to more effective and efficient cutting in high speed applications.

Other modifications and variations of PCD composites as practiced according to the principles of this invention will be apparent to those skilled in the art. It is, therefore, to be understood that within the scope of the appended claims, this invention may be practiced otherwise than as specifically described.

What is claimed is:

1. A polycrystalline diamond composite comprising:

a polycrystalline diamond body having a plurality of discrete regions that are dispersed within a continuous polycrystalline diamond second region that extends throughout the body and that insulates the discrete regions from one another, wherein the plurality of discrete regions are formed from polycrystalline diamond, have an average size of about 100 to 250 microns, and have a diamond density greater than that of a diamond density of the surrounding continuous polycrystalline diamond second region, and wherein the continuous polycrystalline diamond second region comprises a matrix formed of intercrystalline bonded together diamond crystals that extends continuously throughout the second region, and wherein the second region further comprises interstitial regions disposed within the matrix that are filled with a catalyst material used to sinter the second region at high pressure/high temperature conditions, and wherein the plurality of discrete regions exist separately from the interstitial regions.

2. The polycrystalline diamond composite as recited in claim 1 wherein the discrete regions are relatively more thermally stable than the polycrystalline diamond region.

3. The polycrystalline diamond composite as recited in claim 2 wherein the discrete regions are thermally stable at operating temperatures that are greater than about 750° C.

4. The polycrystalline diamond composite as recited in claim 2 wherein the discrete regions are thermally stable at operating temperatures up to about 950° C.

5. The polycrystalline diamond composite as recited in claim 2 wherein the discrete regions are thermally stable at operating temperatures up to about 1,200° C.

6. The polycrystalline diamond composite as recited in claim 1 wherein the discrete regions have a diamond density that is greater than about 98 percent by volume.

7. The polycrystalline diamond composite as recited in claim 1 wherein the discrete regions comprise a catalyst material that is different from that in the interstitial regions of the polycrystalline diamond second region.

8. The polycrystalline diamond composite as recited in claim 7 wherein the catalyst material in the discrete regions has a melting temperature that is less than that of the catalyst material in the polycrystalline diamond second region.

9. The polycrystalline diamond composite as recited in claim 7 wherein the catalyst material in the discrete regions has a coefficient of thermal expansion that more closely matches that of the polycrystalline diamond of the discrete regions as compared to the catalyst material in the polycrystalline diamond second region.

10. The polycrystalline diamond composite as recited in claim 1 wherein the plurality of discrete regions are substantially uniformly dispersed within the polycrystalline diamond second region.

11. The polycrystalline diamond composite as recited in claim 1 wherein the plurality of discrete regions are localized within the body adjacent to at least a portion the body outside surface.

12. The polycrystalline diamond composite as recited in claim 1 further comprising a metallic substrate joined to the body.

13. A bit for drilling earthen formations comprising a body, a plurality of blades extending from the body, and one or more cutting elements disposed on the blades, wherein the one or more cutting element comprises the polycrystalline diamond composite recited in claim 1.

14. A bit for drilling earthen formations comprising:

a body having a head and having a number of blades extending away from a surface of the head, the blades being adapted to engage a subterranean formation during drilling;

a plurality of shear cutters disposed in the blades to contact the subterranean formation during drilling, wherein the shear cutters are formed from a PCD composite construction including:

a polycrystalline diamond body having a plurality of discrete regions that are dispersed within a continuous polycrystalline diamond second region that extends throughout the body and that insulates the discrete regions from one another, wherein the plurality of discrete regions comprises polycrystalline diamond, have an average size of from about 100 to 250 microns, and wherein the plurality of discrete regions are relatively more thermally stable than the continuous polycrystalline diamond second region, and wherein the polycrystalline diamond second region comprises a continuous matrix formed of intercrystalline bonded together diamond crystals, the matrix extending that extends continuously throughout the second region, wherein the second region further comprises interstitial regions disposed within the matrix, and wherein the plurality of discrete regions exist independent of the interstitial regions; and a substrate attached to the body.

15. The bit as recited in claim 14 wherein the discrete regions have a diamond density that is greater than about 98 percent by volume.

16. The bit as recited in claim 14 wherein the discrete regions comprise a catalyst material that is different from that in the polycrystalline diamond second region that is disposed in the interstitial regions.

17. The bit as recited in claim 16 wherein the catalyst material in the discrete regions has a melting temperature that is less than that of the catalyst material in the polycrystalline diamond second region.

18. The bit as recited in claim 16 wherein the catalyst material in the discrete regions has a coefficient of thermal expansion that more closely matches that of the polycrystalline diamond of the discrete regions as compared to the catalyst material in the polycrystalline diamond second region.

19. The bit as recited in claim 14 wherein the plurality of discrete regions are localized within the body adjacent to at least a portion the body outside surface.

20. The bit as recited in claim 14 wherein the interstitial regions are filled with a catalyst material.

21. The bit as recited in claim 14 wherein the plurality of discrete regions are thermally stable at drill bit operating temperatures of greater than about 750° C.

22. The bit as recited in claim 14 wherein the discrete regions have a diamond density greater than a diamond density of the polycrystalline diamond second region.

23. A polycrystalline diamond composite comprising:

a polycrystalline diamond body having a plurality of discrete regions that are dispersed within a continuous polycrystalline diamond second region that extends throughout the body and that insulates the discrete regions from one another, wherein the plurality of discrete regions are formed from polycrystalline diamond, have an average size of about 100 to 250 microns, and have a higher abrasion resistance that that of the surrounding continuous polycrystalline diamond second region, and wherein the continuous polycrystalline diamond second region comprises a matrix formed of intercrystalline bonded together diamond crystals that extends continuously throughout the second region, and wherein the second region further comprises interstitial regions disposed within the matrix that are filled with a catalyst material used to sinter the second region at high pressure/high temperature conditions, and wherein the plurality of discrete regions exist separately from the interstitial regions.

* * * * *